United States Patent [19]

Perner

[11] 4,206,074

[45] Jun. 3, 1980

[54] EXTREMELY LOW-FOAMING SURFACTANT SYSTEM

[75] Inventor: Johannes Perner, Neustadt, Fed. Rep. of Germany

[73] Assignee: BASF Aktiengesellschaft, Fed. Rep. of Germany

[21] Appl. No.: 908,445

[22] Filed: May 22, 1978

[30] Foreign Application Priority Data

May 23, 1977 [DE] Fed. Rep. of Germany ..... 2723139

[51] Int. Cl.[2] ..... B01F 17/16; B01F 17/42

[52] U.S. Cl. ..... 252/351; 252/357

[58] Field of Search ..... 252/351, 357

[56] References Cited

U.S. PATENT DOCUMENTS 3,314,891 4/1967 Schmolka et al. ..... 252/89

*Primary Examiner*—E. Suzanne Parr

*Attorney, Agent, or Firm*—Keil & Witherspoon

[57] ABSTRACT

A surfactant system comprising block copolymers of ethylene oxide and propylene oxide and/or their derivatives and adducts of ethylene oxide and propylene oxide with dipropylene glycol.

1 Claim, 3 Drawing Figures

EXTREMELY LOW-FOAMING SURFACTANT SYSTEM

Figure 1:
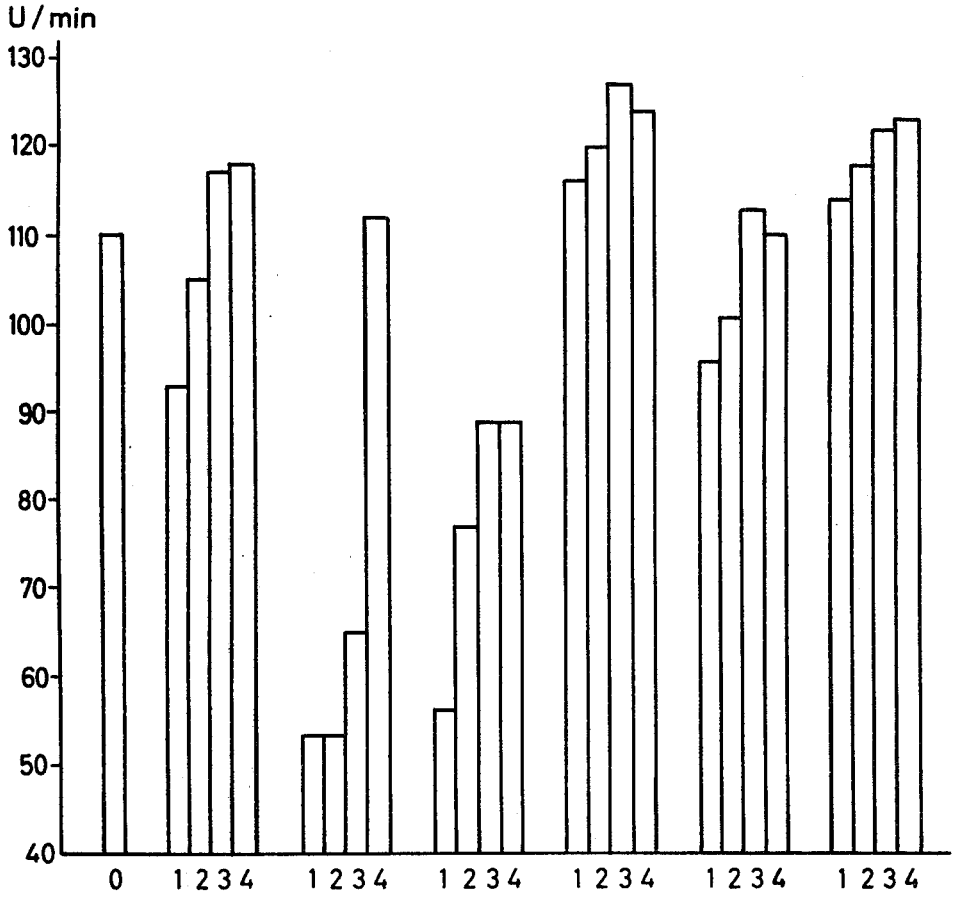

The present invention relates to a synergistic mixture of certain low-foaming non-ionic surfactants, which is particularly low-foaming, as compared to the individual components.

Such systems are highly desirable for cleaning processes which entail high mechanical stresses, i.e. for processes such as dishwashing and bottlewashing.

Hitherto, non-ionic surfactants based on block copolymers of ethylene oxide and propylene oxide or their derivatives, i.e. derivatives of compounds containing active H, which have undergone block adduct formation with ethylene oxide and propylene oxide, have been used particularly as the standard surfactants for this purpose, since they are low-foaming. With such systems it is often necessary to strike a compromise between low foaming and wetting or detergent action.

Systems with sizable ethylene oxide blocks, i.e. systems in which the hydrophilic components predominate, generate a relatively large amount of foam. The converse is observed if the propylene oxide block predominates; the system foams less, since the hydrophobic constituents predominate. On the other hand, the optimum cleaning action corresponds to a relatively high proportion of ethylene oxide. It has therefore frequently been necessary to add anti-foam agents to block copolymers with particular and defined proportions of ethylene oxide and propylene oxide, which copolymers have been particularly designed to have a high cleansing power. The anti-foam agents used in such cases were defined amounts of block copolymers of ethylene oxide and propylene oxide in which the proportion of hydrophobic constituent was relatively large and where low foaming was coupled with low cleansing power. This combination gave relatively little foam, whilst the cleansing action remained adequate. The same situation was achieved with copolymers in which the ethylene oxide and propylene oxide were present in such proportions as to bring about the above compromise, i.e. relatively low foaming coupled with cleansing power which still remained adequate for industrial purposes.

It will be appreciated that whilst these solutions sufficed in many cases, they did not give optimum results. In particular, cleaning processes entailing high mechanical stresses, e.g. mechanical dishwashing or bottlewashing, require not only very good wetting and cleaning power, but also very low foaming.

It is an object of the present invention to provide a surfactant system based on block polymers of ethylene oxide and propylene oxide which is very low foaming whilst giving improved wetting power and cleaning power.

I have found that this object is achieved, surprisingly, with a surfactant system based on block polymers of ethylene oxide and propylene oxide and/or their derivatives, which comprises:

(a) from 50 to 90 percent by weight, based on the system, of one or more compounds of the formulae I, II and/or III $$(OC_2H_4)_mR—(OC_3H_6)_nOH \qquad \text{I}$$

$$H(OC_2H_4)_{n'}(OC_3H_6)_{m'}(OC_2H_4)_{n'}—OH \qquad \text{II}$$

and/or

III $$\begin{array}{ccc} H(OH_4C_2)_{n''}(OC_3H_6)_{m''} & & (C_3H_6O)_{m''}(C_2H_4O)_{n''}H \\ & \diagdown \quad \diagup & \\ & NCH_2CH_2N & \\ & \diagup \quad \diagdown & \\ H(OH_4C_2)_{n''}(OC_3H_6)_{m''} & & (C_3H_6O)_{m''}(C_2H_4O)_{n''}H \end{array}$$

where m is from 5 to 20, n is from 5 to 20, m' is from 15 to 100, n' is from 1 to 20, m'' is from 3 to 40, n'' is from 1 to 15 and R is the radical of a straight-chain or branched fatty alcohol of 8 to 22 carbon atoms, and where the oxyethylene and oxypropylene groups, in formula I, are arranged at random or in blocks, and (b) from 10 to 50 percent by weight, based on the system, of one or more compounds of the formula IV $$H(OC_3H_6)_y(OC_2H_4)_x—O—\underset{\underset{CH_3}{|}}{CH}—CH_2—O—\underset{\underset{CH_3}{|}}{CH}—CH_2— \qquad \text{IV}$$
$$—O(C_2H_4O)_x(C_3H_6O)_yH$$

where x is from 5 to 50 and y is from 10 to 100.

The components a which have the formula I, II or III are, without exception, surfactants which contain such an amount of propylene oxide as to realize the above compromise between low foaming and wetting power.

Component b of the formula IV contains a large excess of propylene oxide and hence per se is a very low foaming surfactant of relatively poor wetting power. In conjunction with more strongly foaming surfactants containing a higher proportion of ethylene oxide, component b acts as an anti-foam agent, but the low level of foaming numerically never completely attains as low values as those achievable with component b alone.

The invention is based on the surprising synergistic effect which results in even less foaming than with constituent b, and even better wetting power and detergency than with constituent a. It was not to be expected that on the one hand a system with excess hydrophobic constituents would acquire better wetting power by adding further surfactants rich in hydrophobic constituents and that, on the other hand, a powerful anti-foam system, in conjunction with a less powerful anti-foam compound, would in total produce even less foam.

This unexpected synergism, for which I cannot offer an explanation, now permits an advantageous and effective improvement in the processes of, in particular, dishwashing and bottlewashing.

According to the invention, component a may consist of one or more compounds of the formula I, II or III or of a mixture of such compounds.

The compounds of the formula I are conventional oxyalkylated fatty alcohols, where alkyl is of 8 to 22, preferably of 10 to 18, carbon atoms and is straight-chain or branched, preferably branched. The preferred examples of such alcohols are natural fatty alcohols, e.g. n-decyl alcohol, n-dodecyl alcohol, n-palmityl alcohol and stearyl alcohol, as well as synthetic fatty alcohols and, preferably, mixtures of such alcohols, formed by the oxo synthesis. In particular, the $C_{13}/C_{15}$, $C_{17}/C_{19}$ and $C_9/C_{11}$ cuts are suitable. The alcohol is first reacted with from 5 to 20 (i.e. with m) moles of ethylene oxide and then with from 5 to 20 (i.e. with n) moles of propylene oxide. Preferably, m:n is from 1:0.3 to 1:0.8. Within the above ratios, ethylene oxide and propylene oxide may also be used as a mixture for forming the adduct. Preferred examples of compounds of the formula I are $C_{13}/C_{15}$ oxo-alcohols which contain from 6 to 13 moles of propylene oxide and from 5 to 20 moles of ethylene oxide, within the limits of the above preferred ratios, as blocks or as a mixture.

Examples of compounds of the formula II are conventional oxyethylation products of polypropylene glycol. Here again the propylene oxide constituent (m') constitutes an excess over the two polyethylene oxide blocks (n' each). m' should be from 15 to 100, preferably from 20 to 60, and n' should be from 1 to 20, preferably from 2 to 15. The preferred ratio of n':m' is from 1:2 to 1:5.

Examples of compounds of the formula III are oxyalkylation products of ethylenediamine, which have also been disclosed as low-foaming surfactants. In this last category of compounds, the active hydrogens are replaced by propylene oxide blocks which in turn have undergone adduct formation with ethylene oxide blocks. Here again, the molecule contains more propylene oxide than ethylene oxide; preferably, the ratio m":n' is from 1:0.2 to 1:1, preferably from 1:0.2 to 1:0.8.

Component a accounts for from 50 to 90, preferably from 70 to 90, percent by weight of the total system.

Component b is a block copolymer of the formula IV. It is obtained by oxyethylating dipropylene glycol and then oxypropylating the product. The propylene oxide is present in a very large excess over ethylene oxide, i.e. x is from 5 to 50 and y is from 10 to 100.

Component b accounts for from 10 to 50, preferably from 10 to 30, percent by weight of the total system.

The preparation of the individual compounds has been disclosed and will only be discussed briefly, for greater ease of reference.

The propoxylation is preferably carried out with an alkaline catalyst at from 110° to 140° C. and from 3 to 10 bars, in a closed system. The oxyethylation takes place under the same pressures, at from 100° to 130° C. A summary of the oxyalkylation literature may be found in Schwartz/Perry "Surface Active Agents and Detergents", Volumes I and II, Interscience Publ., New York.

The new surfactants are above all important for dishwashing processes. Their extremely low foaming and improved wetting power is illustrated by the Examples which follow.

EXAMPLES

The foam test results were obtained by using a domestic dishwasher. The rate of revolution of the spray arm is a measure of the foam generated in the dishwasher. High rates of revolution indicate low foaming. 20 g of a dishwashing detergent composed of 1 g of surfactant mixture and 19 g of a base powder comprising 50% of Na metasilicate, 45% of pentasodium triphosphate and 5% of sodium carbonate, were employed. The results may be seen from FIGS. 1 to 3. The symbols have the following meanings:

In FIG. 1

Figure 2:
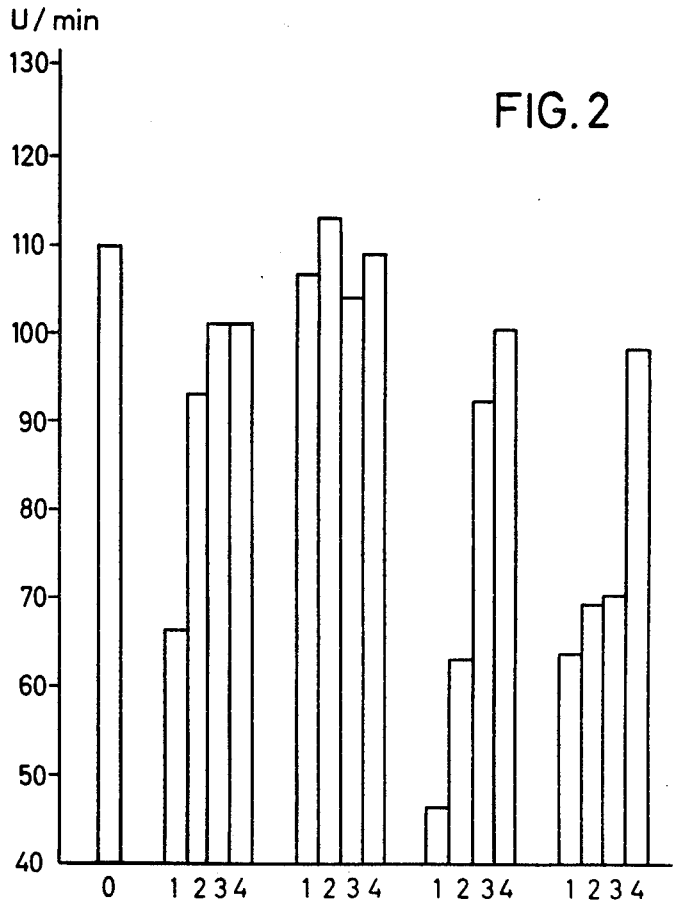

0=a block copolymer of 36% of ethylene oxide (EO), 62% of propylene oxide (PO) and 2% of dipropylene glycol (structure as in formula IV)
1=$C_{13}/C_{15}$ oxo-alcohol+6.5 moles of EO +3.5 moles of PO
2=90% of 1+10% of 0
3=75% of 1+25% of 0
4=50% of 1+50% of 0 in FIG. 2

Figure 3:
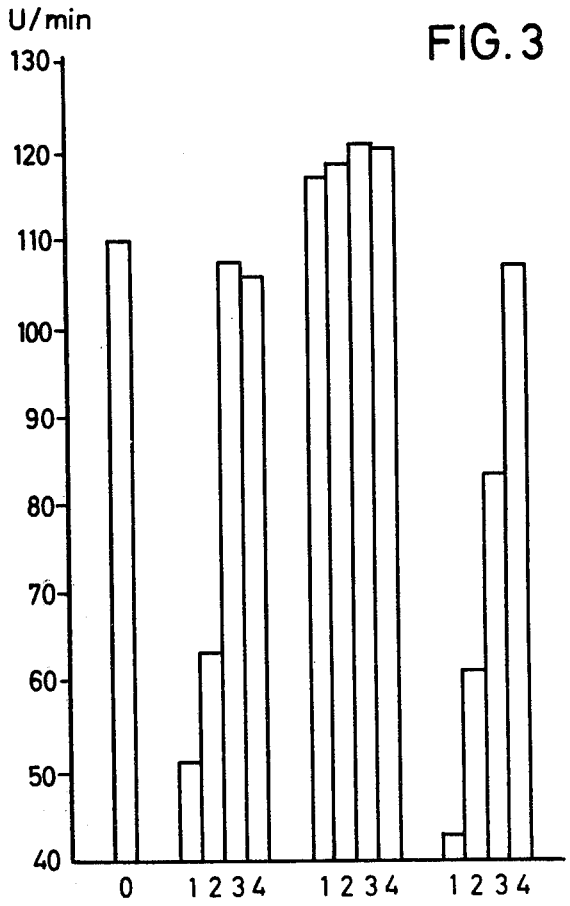

0=see FIG. 1
1=block copolymer of 90% of PO and 10% of EO
2+90% of 1+10% of 0
3+75% of 1+25% of 0
4+50% of 1+50% of 0 in FIG. 3

0=see FIG. 1
1=an adduct of 84.6% of PO and 14.2% of EO with 1.2% of ethylenediamine
2=90% of 1+10% of 0
3=75% of 1+25% of 0
4=50% of 1+50% of 0

I claim:

1. A surfactant system based on block polymers of ethylene oxide and propylene oxide, their derivatives or their mixtures, which consists essentially of the following:

(a) from 50 to 90 percent by weight, based on the system, of one or more compounds of the formula I, II and/or III $$(OC_2H_4)_mR-(OC_3H_6)_nOH \qquad \text{I}$$

$$H(OC_2H_4)_{n'}(OC_3H_6)_{m'}(OC_2H_4)_{n'}-OH \qquad \text{II}$$

or

III

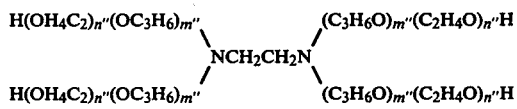

where m is from 5 to 20, n is from 5 to 20, m' is from 15 to 100, n' is from 1 to 20, m" is from 3 to 40, n" is from 1 to 15 and R is the radical of a straight-chain or branched fatty alcohol of 8 to 22 carbon atoms, and where the oxyethylene and oxypropylene groups, in formula I, are arranged at random or in blocks, or a mixture of compounds of the formulae I to III, and (b) from 10 to 50 percent by weight, based on the system, of one or more compounds of the formula IV

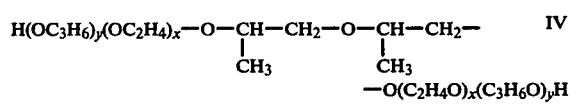

IV where x is from 5 to 50 and y is from 10 to 100.

* * * * *